US008653701B2

(12) United States Patent
Lai

(10) Patent No.: US 8,653,701 B2
(45) Date of Patent: Feb. 18, 2014

(54) OUTDOOR EXTENSION LINE SOCKET ENABLING ROMOTE CONTROLLED TIMING POWER SUPPLY

(76) Inventor: Li-Chun Lai, Panciao (TW)

( * ) Notice: Subject to any disclaimer, the term of this patent is extended or adjusted under 35 U.S.C. 154(b) by 782 days.

(21) Appl. No.: 12/915,228

(22) Filed: Oct. 29, 2010

(65) Prior Publication Data

US 2012/0104869 A1 May 3, 2012

(51) Int. Cl.
*H01H 47/00* (2006.01)

(52) U.S. Cl.
USPC ..... 307/116; 307/132 E; 307/141.4

(58) Field of Classification Search
USPC ..... 307/116, 132 E, 141.4
See application file for complete search history.

(56) References Cited

U.S. PATENT DOCUMENTS

| | | | | |
|---|---|---|---|---|
| 8,531,306 | B2 * | 9/2013 | Qin | 340/664 |
| 2011/0031819 | A1 * | 2/2011 | Gunwall | 307/141.4 |
| 2011/0156496 | A1 * | 6/2011 | Lee et al. | 307/117 |

* cited by examiner

*Primary Examiner* — Rexford Barnie
*Assistant Examiner* — Dru Parries
(74) *Attorney, Agent, or Firm* — Ming Chow; Sinorica, LLC

(57) ABSTRACT

An outdoor extension line socket enabling remote controlled timing power supply is disclosed, comprising a socket body and a remote controller body, in which the bottom of the socket body is formed as a tapered body for sticking the socket body into the ground. The socket body consists of a socket, a display, a time adjustment button, an extension line plug and a socket power control circuit. In addition, the remote controller body consists of a time adjustment wheel, two switch control buttons and a remote control circuit. As the socket body being stuck on the outdoor ground, it is possible to provide electric power required for operations of an outdoor electronic device, and the power supply time of the socket body can be adjusted in accordance with the settings done by the remote controller body so as to designate the operation time of the outdoor electronic device.

7 Claims, 7 Drawing Sheets

OUTDOOR EXTENSION LINE SOCKET ENABLING ROMOTE CONTROLLED TIMING POWER SUPPLY

BACKGROUND OF THE INVENTION

1. Field of the Invention

The present invention relates to an outdoor extension line socket enabling remote controlled timing power supply; in particular, to a remote controlled extension line socket applicable for outdoor environment thereby allowing a user to set from afar the power supply time of an outdoor electronic device by means of remote control.

2. Description of Related Art

At present, many families have their own yard and several electronic devices may be installed therein (an outdoor lighting apparatus, for example); however, it usually needs to utilize an extension line socket to extend from indoor power outlet to outdoor environment in order to provide electric power that the outdoor electronic device needs to use, hence the extension line socket applicable for outdoor environment is more and more comprehensively utilized. But, a general extension line socket may not be able to be fixedly positioned due to mobility of such outdoor electronic devices, or even the power line of the extension line socket may come loose; additionally, in rainy days, the problem of short circuit in the extension line socket could happen because rainwater may infiltrate, so a user may be dangerously exposed to the risk of injury caused by lethal electric shocks once the user touches the wet extension line socket.

Furthermore, a general extension line socket is not able to designate the duration of power supply, so the switch time of the electronic device can not be suitably controlled according to the user's demand; thus, in the premises of environment protection, such a general extension line socket can neither effectively save energies nor meet the requirement on environment protection.

It can be seen from aforementioned texts that a general extension line socket is not well applicable for outdoor usage, the operation thereof could easily jeopardize the safety of a user, and the requirement for power-saving can not be fulfilled. Consequently, it is desirable to provide an outdoor extension line socket enabling remote controlled timing power supply which allows to control the power supply time from afar specifically with regards to the extension line socket applied in the outdoor environment, effectively prevent the user from dangerous electric shocks and also present the benefit of energy-saving.

SUMMARY OF THE INVENTION

An objective of the present invention is to provide an outdoor extension line socket enabling remote controlled timing power supply which is applicable for outdoor environment and can designate from a distant place the power supply time for an outdoor electronic device by means of remote control.

Another objective of the present invention is to provide an outdoor extension line socket enabling remote controlled timing power supply which set the power supply time essentially through remote control thereby effectively controlling the use and switching of an outdoor electronic device so as to achieve the goals of environment protection and energy-saving at the same time.

An outdoor extension line socket enabling remote controlled timing power supply capable of achieving above-said objectives is disclosed, comprising a socket body and a remote controller body, in which the bottom of the socket body is formed as a tapered body for sticking the socket body into the ground. A socket is installed on one side of the socket body, and a display and a time adjustment button are installed on the top of the socket body; besides, a socket power control circuit is installed inside the socket body and an extension line plug extends from the socket body for input of alternating current (AC) power. The controller body is able to emit a radio frequency (RF) signal for remotely controlling the socket body, and a time adjustment wheel, a first switch control button and a second switch control button are installed on the surface of the controller body; in addition, a remote control circuit is installed inside the remote controller body.

Consequently, the socket body can be stuck on the outdoor ground thereby providing required electric power for operations of the outdoor electronic device, and the power supply time of the socket body can be adjusted in accordance with the settings done by the remote controller body so as to designate the operation time of the outdoor electronic device.

DETAILED DESCRIPTION OF THE PREFERRED EMBODIMENTS

Figure 1A:
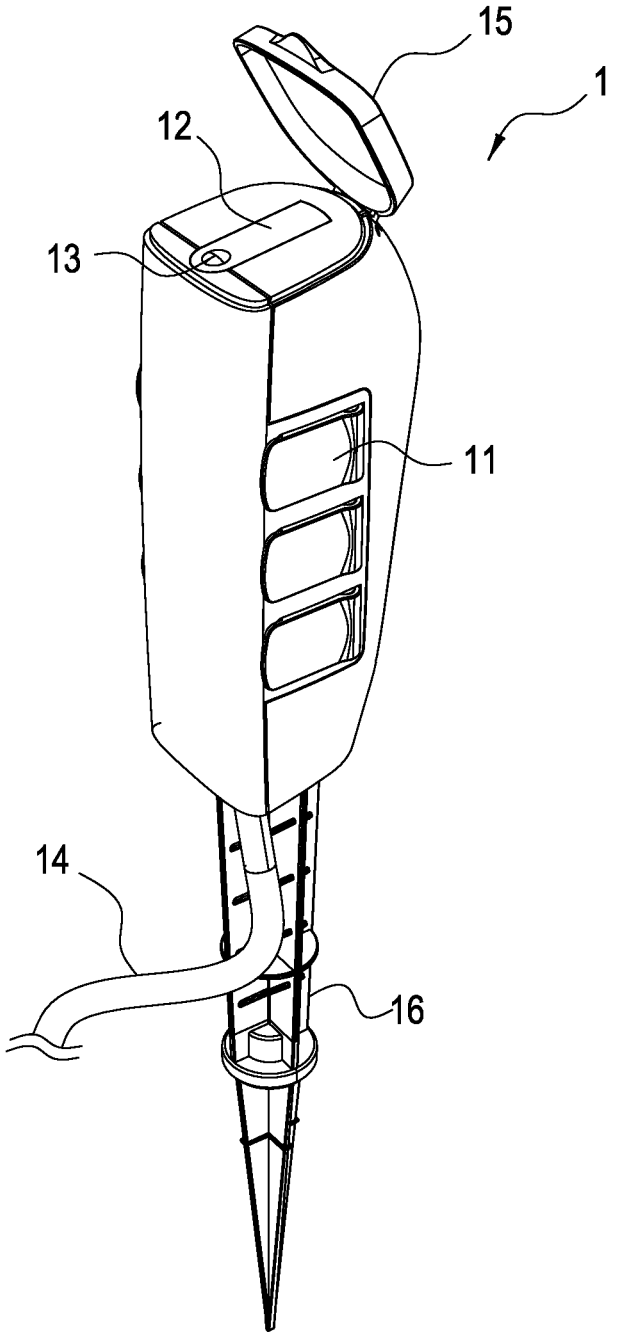
FIG. 1A shows a structural perspective view of the socket body in the outdoor extension line socket enabling remote controlled timing power supply according to the present invention.
Figure 1B:
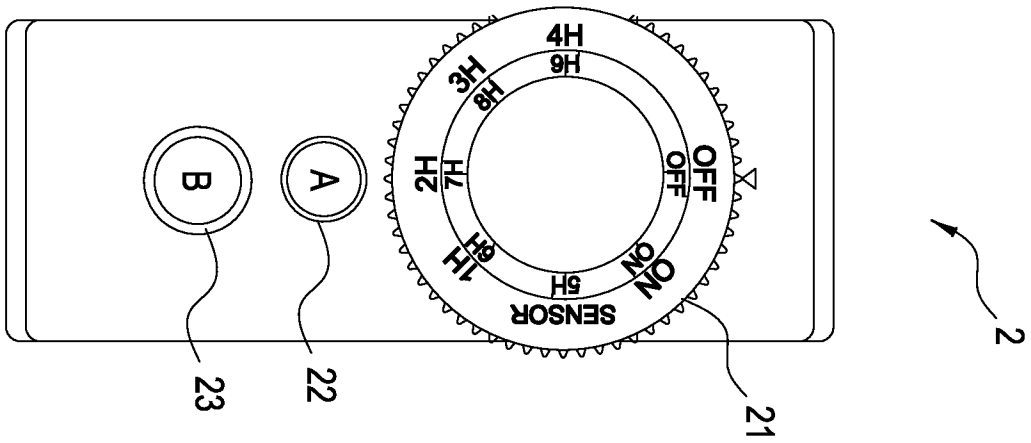
FIG. 1B shows a structural perspective view of the remote controller body in the outdoor extension line socket enabling remote controlled timing power supply according to the present invention.

First of all, refer conjunctively to FIGS. 1A, 1B, 2, 3 and 4, wherein a structural perspective view for the socket body, a structural perspective view for the remote controller, a block diagram for the socket power control circuit, a block diagram for the remote control circuit and a diagram for an embodiment of the outdoor extension line socket enabling remote controlled timing power supply according to the present invention are respectively shown. It can be seen from such drawings that the outdoor extension line socket enabling remote controlled timing power supply according to the present invention is applicable for provision of electric power to an outdoor electronic device 3, in which the outdoor extension line socket enabling remote controlled timing power supply comprises:

a socket body 1, as shown in FIG. 1A, in which the socket body 1 is used to provide required power for the outdoor electronic device 3, and the bottom of the socket body is formed as a tapered body 16 for sticking the socket body 1 into the ground; a socket 11 is installed on one side of the socket body 1, and a display 12 and a time adjustment button 13 are installed on the top of the socket body 1. Besides, a socket power control circuit is installed inside the socket body 1 and an extension line plug 14 extends from the socket body 1 for input of AC power;

a remote controller body 2, as shown FIG. 1B, in which the remote controller body 2 emits an RF signal for remotely controlling the socket body 1, and a time adjustment wheel 21, a first switch control button 22 and a second switch control button 23 are installed on the surface of the controller body 2; in addition, a remote control circuit is installed inside the remote controller body 2. The socket body 1 can be stuck on the outdoor ground in order to provide the outdoor electronic device 3 with electric power required for operations, and the remote controller body 2 can be used to set and adjust the power supply time of the socket body 1 thereby configuring the operation time of the outdoor electronic device 3.

It should be noted that, as shown in FIG. 1A, the top of the socket body 1 is additionally installed with a cover 15 which is used to shelter the display 12 and the time adjustment button 13 to prevent outdoor rainwater from wetting the display 12 and the time adjustment button 13 which may otherwise cause failures in such components.

It should be noted that, as shown in FIG. 1A, the time adjustment button 13 on the socket body 1 allows the user to set the power supply time manually.

It should be noted that, as shown in FIG. 1A, the display 12 on the socket body 1 is used to display the designated power supply time, and the display 12 can be a seven-segment display or composed of light emitting diodes.

It should be noted that, as shown in FIG. 1B, the time adjustment wheel 21 on the remote controller body 2 can remotely set the power supply time and consists of two sets of time setting specification thereby allowing the user to switch the first switch control button 22 and the second switch control button 23 in order to apply a different time setting specification.

Figure 2:
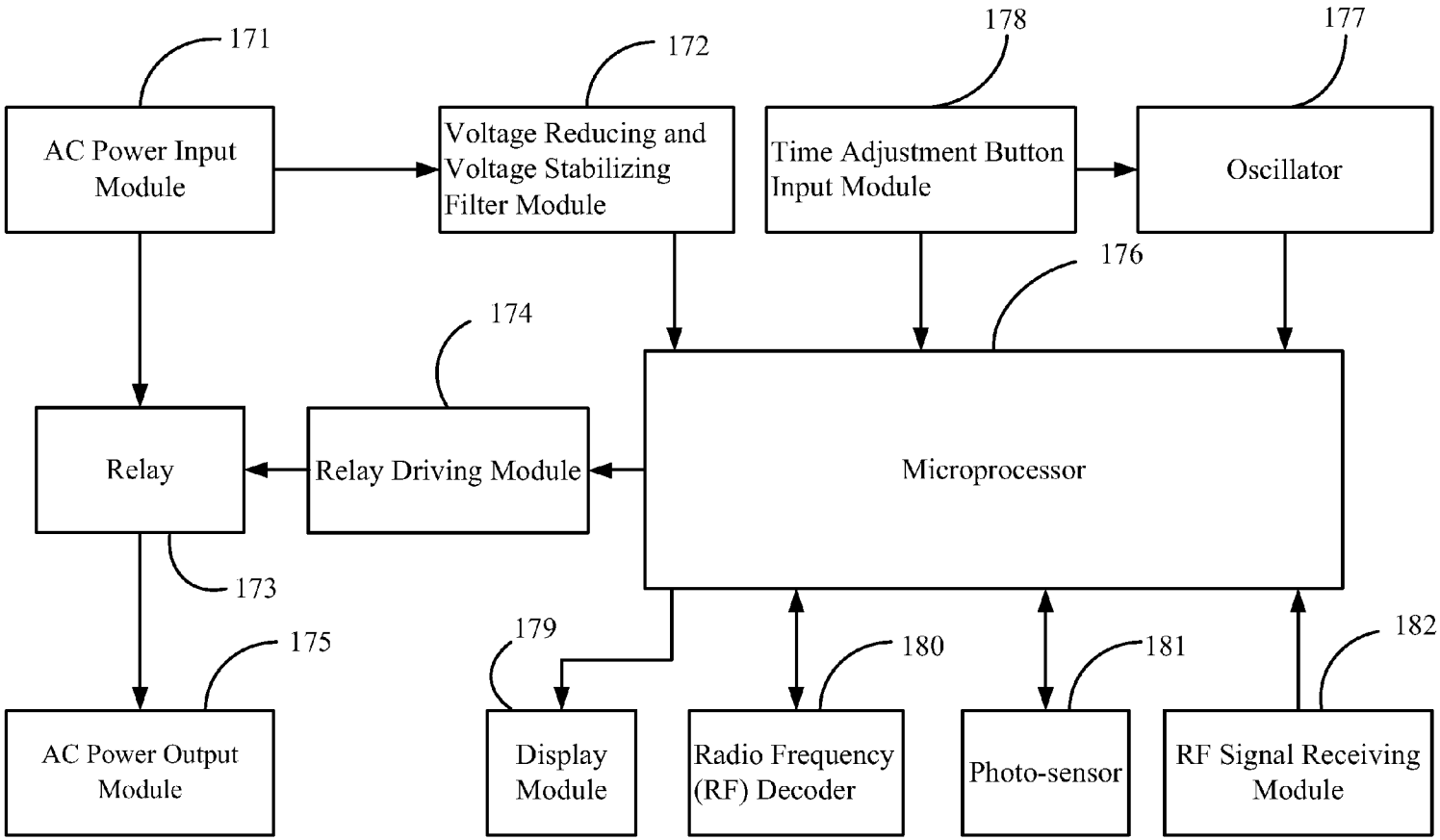
FIG. 2 shows a block diagram for the socket power control circuit of the outdoor extension line socket enabling remote controlled timing power supply according to the present invention.

It should be noted that, as shown in FIG. 2, the socket power control circuit is used to designate the power supply time of the socket body 1, which consists of an AC power input module 171, a voltage reducing and voltage stabilizing filter module 172, a relay 173, a relay driving module 174, an AC power output module 175, a microprocessor 176, an oscillator 177, a time adjustment button input module 178, a display module 179, an RF decoder 180, a photo-sensor 181 and an RF signal receiving module 182, in which the microprocessor 176 is interfaced with the voltage reducing and voltage stabilizing filter module 172, the relay driving module 174, the oscillator 177, the time adjustment button input module 178, the display module 179, the RF decoder 180, the photo-sensor 181 and the RF signal receiving module 182.

It should be noted that, as shown in FIGS. 1A and 2, the AC power input module 171 inputs AC power via the extension line plug 14 of the socket body 1 and is interfaced with the voltage reducing and voltage stabilizing filter module 172, and the voltage reducing and voltage stabilizing filter module 172 is further interfaced with the microprocessor 176, in which the AC power input module 171 and the voltage reducing and voltage stabilizing filter module 172 are both used to provide electric power required for operations of the microprocessor 176.

It should be noted that, as shown in FIG. 2, the oscillator 177 and the RF signal receiving module 182 are responsible for selectively receiving a constant RF signal which is decoded by the RF decoder 180, and then the power supply time designated by the remote controller body 2 is thus acquired and inputted into the microprocessor 176 of the socket power control circuit. The microprocessor 176 then accordingly starts to count the designated power supply time and the relay driving module 174 is driven by the microprocessor 176 to control the conductivity in the relay 173 such that the AC power output module 175 outputs AC power by way of the socket 11. In addition, at the end of the designated power supply time counted by the microprocessor 176, the relay driving module 174 will be driven so as to control the break in the relay 173 thereby interrupting AC power outputted by the socket 11.

It should be noted that, as shown in FIG. 2, the microprocessor 176 displays the power supply time designated by the remote controller body 2 on the display 12 of the socket body 1 by means of the display module 179.

It should be noted that, as shown in FIG. 2, the time adjustment button input module 178 can input the power supply time specified by the user with the time adjustment wheel 21 to the microprocessor 176 of the socket power control circuit and the display 12 shows the specified power supply time.

Figure 3:
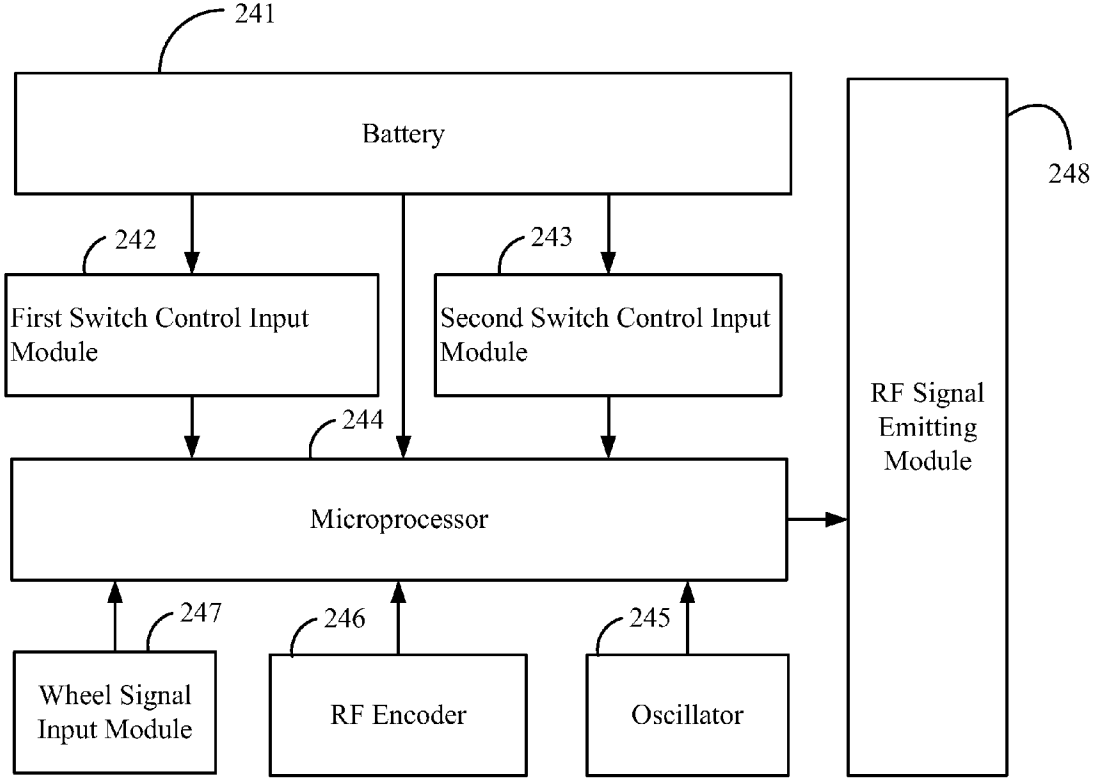
FIG. 3 shows a block diagram for the remote control circuit of the outdoor extension line socket enabling remote controlled timing power supply according to the present invention.

It should be noted that, as shown in FIG. 3, the remote control circuit is used to control the socket body 1 from a distant location, consisting of a battery 241, a first switch control input module 242, a second switch control input module 243, a microprocessor 244, an oscillator 245, an RF encoder 246, a wheel signal input module 247 and an RF signal emitting module 248, in which the battery 241 is interfaced with the first switch control input module 242, the second switch control input module 243 and the microprocessor 244 thereby providing electric power for activation of the remote controller body 2.

It should be noted that, as shown in FIG. 3, the oscillator 245 and the RF encoder 246 convert the power supply time designated by the wheel signal input module 247 into an RF signal, and the microprocessor 244 drives the RF signal emitting module 248 so as to transfer the RF signal to the socket body 1.

Figure 4:
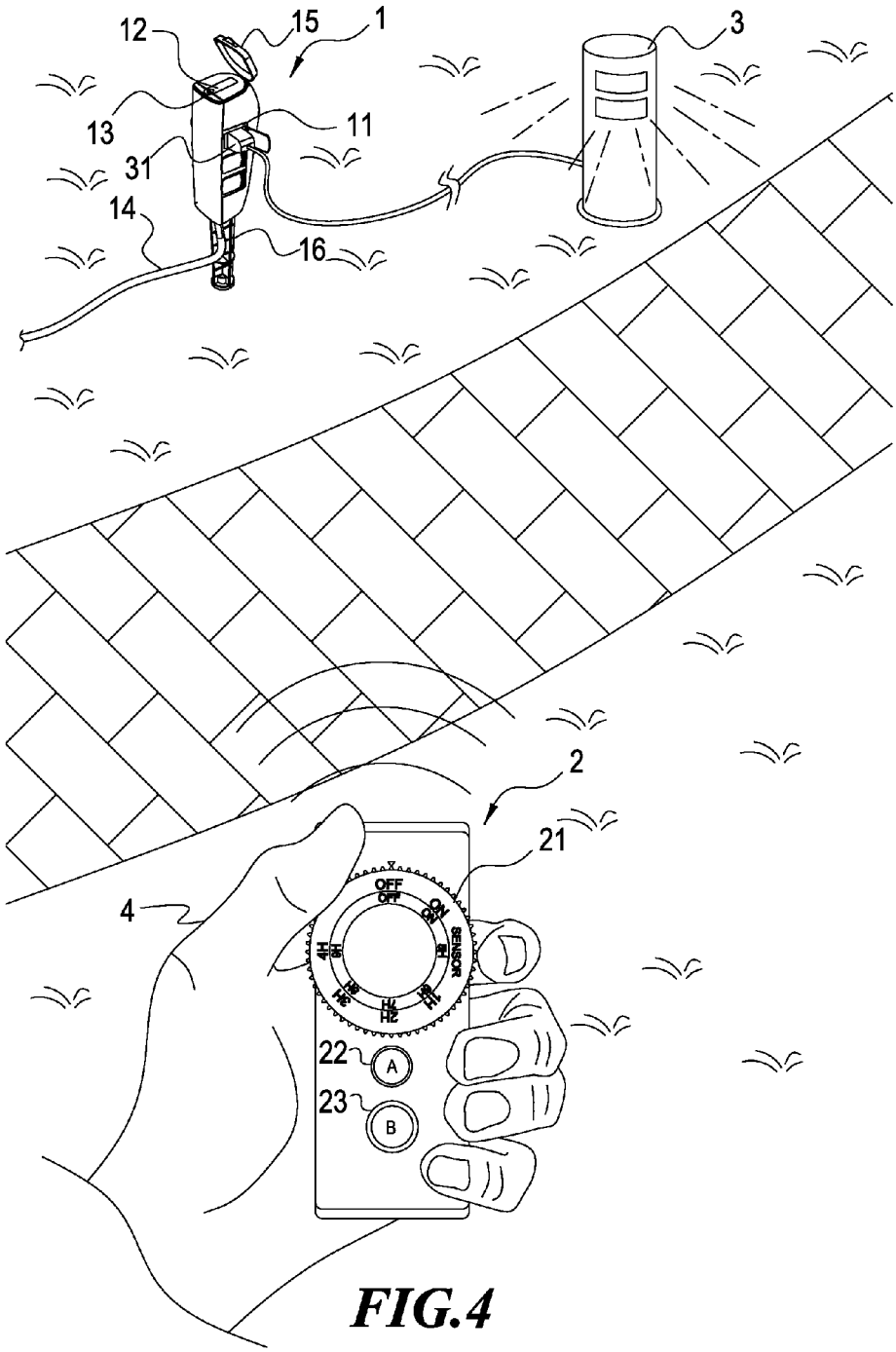
FIG. 4 shows a diagram for an embodiment of the outdoor extension line socket enabling remote controlled timing power supply according to the present invention.

Refer subsequently to FIG. 4, wherein a diagram for an embodiment of the outdoor extension line socket enabling remote controlled timing power supply according to the present invention is shown. It can be seen from the Figure that the socket body 1 is stuck with a plug 31 of an outdoor electronic device 3, and a user 4 can remotely set the power supply time by rotating the time adjustment wheel 21 on the remote controller body 2. The time adjustment wheel 21 on the remote controller body 2 includes two sets of time setting specification (the first set: OFF, ON, SENSOR, 1H, 2H, 3H, 4H; the second set: OFF, ON, 5H, 6H, 7H, 8H, 9H). Upon pressing down the first switch control button 22 by the user 4, the first set of time setting specification can be enabled; contrarily, when the user presses down the second switch control button 23, the second set of time setting specification can be enabled, thereby allowing the user 4 to switch the setting of the power supply time for the outdoor electronic device 3.

It should be noted that, as shown in FIGS. 1A, 1B, 2, 3 and 4, the microprocessor 146 is interfaced with the photo-sensor 181, and when the user 4 sets the time adjustment wheel 21 to SENSOR, the socket body 1 can be switched to be under the control of power supply from the photo-sensor 181; if the photo-sensor 181 detects the approaching of nighttime, the microprocessor 176 accordingly drives the relay driving module 174 to control the conductivity in the relay 173 thereby outputting AC power via the socket 11.

Figure 5A:
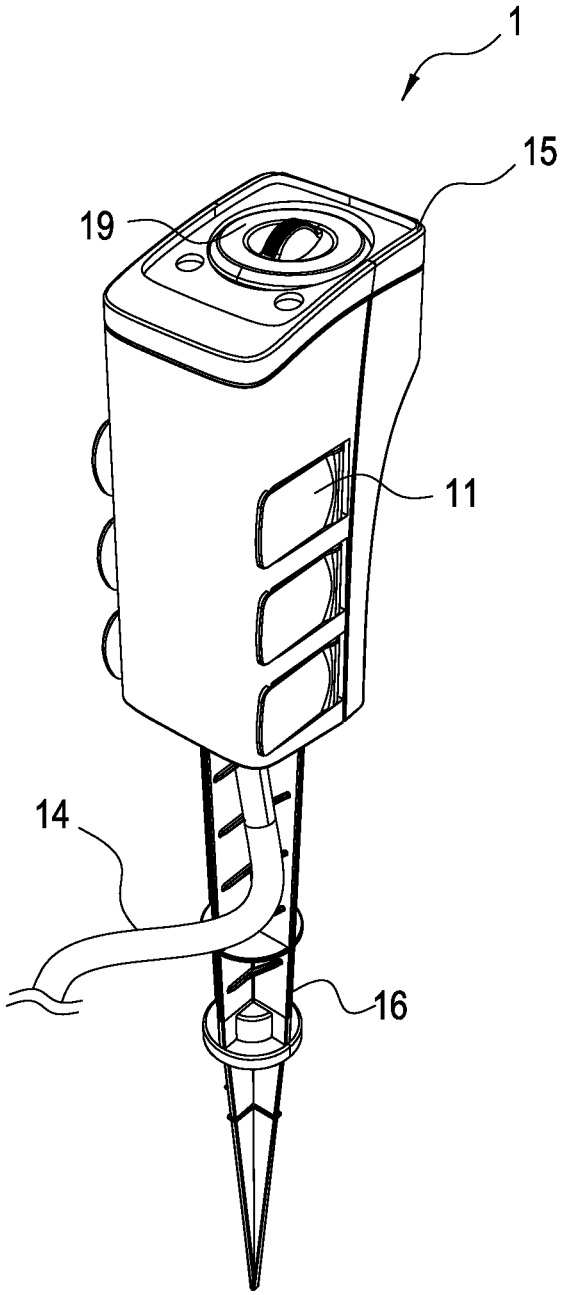
FIG. 5A shows another structural perspective view of the socket body in the outdoor extension line socket enabling remote controlled timing power supply according to the present invention.
Figure 5B:
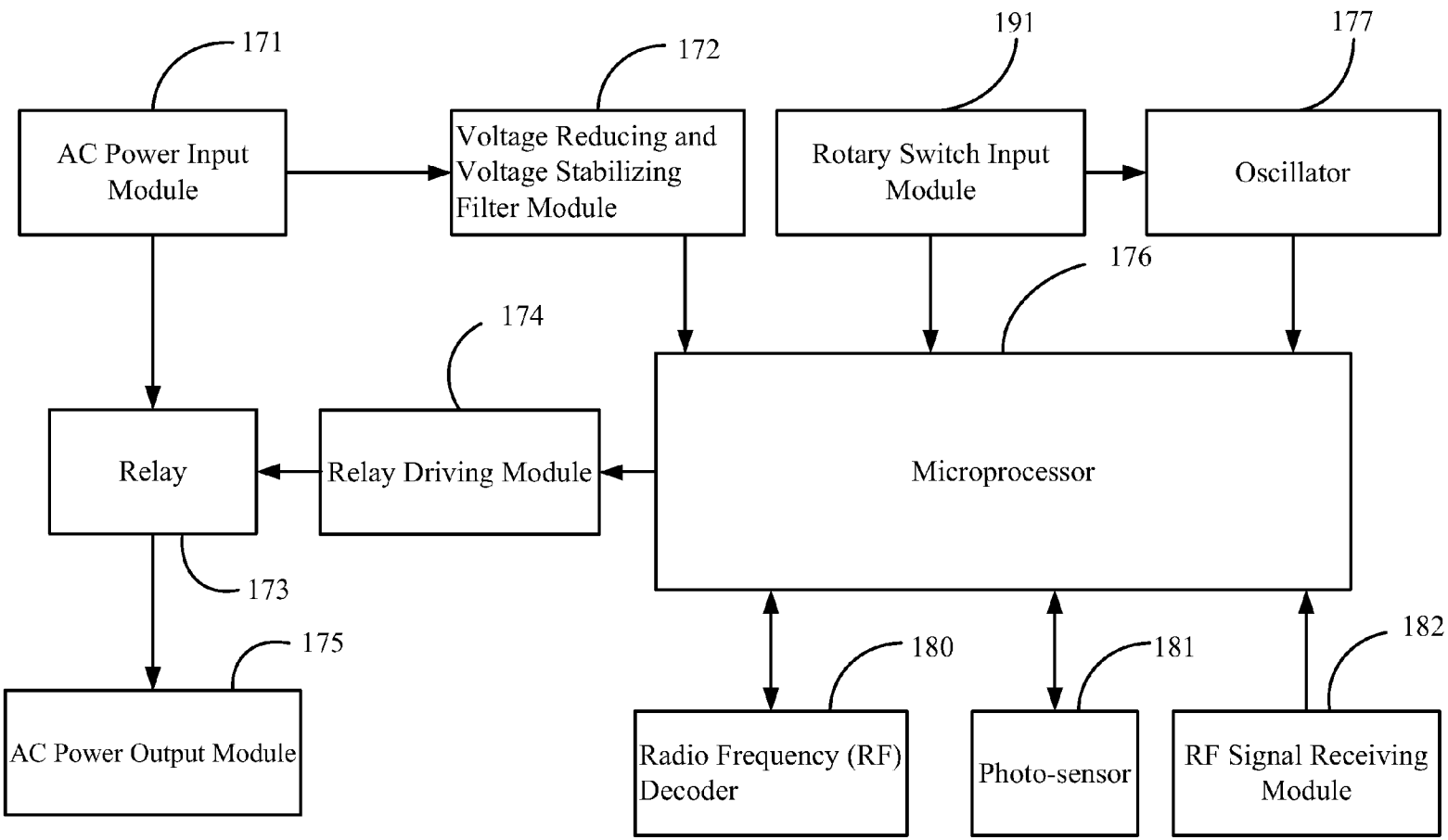
FIG. 5B shows a block diagram for the socket power control circuit of the outdoor extension line socket enabling remote controlled timing power supply according to the present invention.

Refer next to FIGS. 5A and 5B, wherein, in comparison with the aforementioned contents, the difference essentially lies in that the display 12 and the time adjustment button 13 of the socket body 1 are conjunctively replaced with a rotary switch 19 installed on the cover 15; furthermore the time adjustment button input module 178 and the display module 179 of the socket power control circuit are substituted by a rotary switch input module 191. The rest portions thereof are identical to the counterparts in previously illustrated examples and the descriptions thereof are hence omitted for brevity.

Compared with prior art, the outdoor extension line socket enabling remote controlled timing power supply according to the present invention provides the following advantages:

1. by using the present invention in an outdoor environment, it is possible to apply the remote controller to set the power supply time for the outdoor electronic device from a distant location thereby eliminating the risk of electric shock endangering the safety of a user due to the wet extension line socket caused by rainfalls;

2. with remotely controlled configuration of the power supply time, the present invention can controls the use and switch times of an outdoor electronic device so as to achieve the objectives of both environment protection and energy-saving;

3. since the remote controller body of the present invention is installed with only one control wheel and two sets of control buttons are used to switch different time setting specification, the integral structure design can be compact and simple and the operation thereof can be handy as well, thus very suitable for general users.

The detailed descriptions illustrated supra set forth simply the preferred embodiments of the present invention in order to better explain the characteristics and spirit of the present invention; however, the preferred embodiments of the present invention disclosed as above are by no means intended to limit the scope of the present invention thereto. Contrarily, all effectively equivalent changes, alternations, or substitutions conveniently considered by those skilled ones in the art are deemed to be encompassed within the scope of the present invention delineated by the following claims.

What is claimed is:

1. An outdoor extension line socket enabling remote controlled timing power supply, comprising:

a socket body, in which the bottom of the socket body is formed as a tapered body, a socket is installed on one side of the socket body, a socket power control circuit is installed inside the socket body and an extension line plug extends from the socket body for input of alternating current (AC) power, in which the socket power control circuit consists of an AC power input module, a relay, a relay driving module, an AC power output module, a microprocessor, an oscillator, an RF decoder and an RF signal receiving module, in which the AC power input module inputs AC power via the extension line plug of the socket body, the oscillator and the RF signal receiving module connected to the microprocessor of the socket power control circuit are responsible for selectively receiving a constant RF signal which is decoded by the RF decoder, then the power supply time designated by the remote controller body is inputted into the microprocessor of the socket power control circuit so as to count the designated power supply time; then the microprocessor drives the relay driving module to control the conductivity in the relay such that the AC power output module outputs AC power by way of the socket; in addition, at the end of the designated power supply time counted by the microprocessor, the relay driving module is driven so as to control the break in the relay thereby interrupting AC power outputted by the socket; and a remote controller body, which emits a radio frequency (RF) signal to the socket body, wherein a time adjustment wheel, a switch control button are installed on the surface of the controller body, and a remote control circuit is installed inside the remote controller body, in which the remote control circuit is used to remotely control the socket body and consists of a battery, a switch control input module, a microprocessor, an oscillator, an RF encoder, a wheel signal input module and an RF signal emitting module, in which the battery is interfaced with the switch control input module and the microprocessor thereby providing electric power for activation of the remote controller body, and also, the oscillator and the RF encoder connected to the microprocessor of the remote control circuit to convert the power supply time designated by the wheel signal input module into an RF signal, and then the microprocessor drives the RF signal emitting module so as to transfer the RF signal to the socket body, thus the remote controller body is allowed to adjust the power supply time used to set the socket body.

2. The outdoor extension line socket enabling remote controlled timing power supply according to claim 1, wherein a display and a time adjustment button are additionally installed on the top of the socket body, in which the display of the socket body is used to present the designated power supply time, and the display is a seven-segment display or composed of light emitting diodes.

3. The outdoor extension line socket enabling remote controlled timing power supply according to claim 1, wherein the microprocessor of the socket power control circuit is additionally installed with a voltage reducing and voltage stabilizing filter module, a time adjustment button input module and a display module, in which the time adjustment button input module inputs the power supply time designated by the time adjustment button to the microprocessor of the socket power control circuit, and the designated power supply time is presented on the display of the socket body by means of the display module.

4. The outdoor extension line socket enabling remote controlled timing power supply according to claim 1, wherein the time adjustment wheel of the remote controller consists of two sets of time setting specification, and a first switch control button and a second switch control button are installed on the remote controller so as to use different time setting specification by means of the first switch control button and the second switch control button.

5. The outdoor extension line socket enabling remote controlled timing power supply according to claim 1, wherein the socket power control circuit is additionally installed with a photo-sensor, in which the photo-sensor is interfaced with the microprocessor of the power control circuit thereby enabling the power supply to the outdoor electronic device.

6. The outdoor extension line socket enabling remote controlled timing power supply according to claim 1, wherein the top of the socket body is additionally installed with a cover which is used to shelter the display and the time adjustment button.

7. The outdoor extension line socket enabling remote controlled timing power supply according to claim 1, wherein the top of the socket body is additionally installed with a rotary switch and the socket power control circuit is correspondingly installed with a rotary switch input module thereby facilitating configuration of the power supply time.

* * * * *